US012196484B2

(12) United States Patent
Jung et al.

(10) Patent No.: US 12,196,484 B2
(45) **Date of Patent: *Jan. 14, 2025**

(54) REFRIGERATOR

(71) Applicant: LG ELECTRONICS INC., Seoul (KR)

(72) Inventors: Yongrak Jung, Seoul (KR); Kihyun Park, Seoul (KR); Seongjin Na, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/521,692

(22) Filed: Nov. 28, 2023

(65) Prior Publication Data

US 2024/0093935 A1 Mar. 21, 2024

Related U.S. Application Data

(63) Continuation of application No. 17/699,758, filed on Mar. 21, 2022, now Pat. No. 11,867,459.

(30) Foreign Application Priority Data

Apr. 8, 2021 (KR) ..... 10-2021-0045785

(51) Int. Cl.
*F25D 29/00* (2006.01)
*F25D 23/06* (2006.01)
(Continued)

(52) U.S. Cl.
CPC ..... *F25D 29/005* (2013.01); *F25D 23/063* (2013.01); *F25D 25/025* (2013.01); *F25D 27/00* (2013.01); *F25D 2400/40* (2013.01)

(58) Field of Classification Search
CPC ..... F25D 23/021; F25D 25/025; F25D 27/00; F25D 27/005; F25D 29/003; F25D 29/005; F25D 2400/361; F25D 2400/40
See application file for complete search history.

(56) References Cited

U.S. PATENT DOCUMENTS 11,867,459 B2 * 1/2024 Jung ..... F25D 25/025
2006/0077653 A1 * 4/2006 Nowak ..... F21V 17/164 362/133

(Continued)

FOREIGN PATENT DOCUMENTS

CN 201277786 Y 7/2009
DE 10 2018 203 230 A1 9/2019

(Continued)

*Primary Examiner* — Andrew Roersma
(74) *Attorney, Agent, or Firm* — Birch, Stewart, Kolasch & Birch, LLP

(57) ABSTRACT

A refrigerator includes a cabinet including a storage space, a drawer door located in the storage space, the drawer door including a door part and a drawer part connected to the door part, a control panel located on an upper surface of the door part, the control panel being configured to display or manipulate a setting of the storage space, and an electric wire guide module connected to the cabinet and a rear surface of the door part to connect an electric wire in the cabinet to the control panel. The electric wire guide module includes a mounting plate, a rotation connection member rotatably mounted to the mounting plate, a guide head coupled to the rear surface of the door part, and at least one connecting member connecting the rotation connection member and the guide head, the electric wire extending through the at least one connecting member.

20 Claims, 10 Drawing Sheets

(51) Int. Cl.
*F25D 25/02* (2006.01)
*F25D 27/00* (2006.01)

(56) References Cited

U.S. PATENT DOCUMENTS

| | | | |
|---|---|---|---|
| 2009/0167131 | A1 | 7/2009 | Oh et al. |
| 2011/0005264 | A1 | 1/2011 | Lee et al. |
| 2011/0146333 | A1 | 6/2011 | Koo et al. |
| 2013/0092802 | A1 | 4/2013 | Doberstein |
| 2020/0173712 | A1 | 6/2020 | Choi |
| 2020/0408462 | A1 | 12/2020 | Feldmeyer et al. |
| 2021/0003337 | A1 | 1/2021 | Voltarelli et al. |
| 2021/0010745 | A1 | 1/2021 | Choi |
| 2021/0018260 | A1 | 1/2021 | Xu et al. |
| 2021/0025644 | A1 | 1/2021 | Han et al. |
| 2021/0041160 | A1* | 2/2021 | Feldmeyer ..... F25D 25/025 |
| 2022/0128295 | A1 | 4/2022 | Wei et al. |

FOREIGN PATENT DOCUMENTS

| | | | |
|---|---|---|---|
| KR | 10-1831614 | B1 | 2/2018 |
| KR | 10-2020-0066875 | A | 6/2020 |
| KR | 10-2021-0007646 | A | 1/2021 |

* cited by examiner

REFRIGERATOR

CROSS-REFERENCE TO RELATED APPLICATIONS

This application is a Continuation of U.S. application Ser. No. 17/699,758, filed on Mar. 21, 2022, which claims the benefit under 35 U.S.C. § 119(a) to Patent Application No. 10-2021-0045785, filed in the Republic of Korea on Apr. 8, 2021, all of which are hereby expressly incorporated by reference in its entirety.

TECHNICAL FIELD

The present disclosure relates to a refrigerator.

BACKGROUND ART

In general, a refrigerator is a home appliance that can store food at a low temperature in an internal storage space that is shielded by a door. To this end, the refrigerator is configured to store the stored food in an optimal state by cooling the inside of the storage space using cold air generated through heat exchange with the refrigerant circulating in the refrigeration cycle.

In recent years, various large-sized refrigerators have been released according to the convenience of life and the need for storage space. There are various kinds of refrigerators which include a general type in which a freezing compartment is provided at the upper part, a double-door type in which a freezing compartment is provided on one side on the left and right, a mixed type in which the freezing compartment is provided at the lower part, and the like.

Meanwhile, the refrigerator is disclosed in which the freezing compartment of the mixed type refrigerator is provided with a freezing compartment door that opens and closes the freezing compartment while sliding in the front and rear directions of the refrigerator main body, and the freezing compartment door is provided with a control panel for setting temperature conditions and the like of the freezing compartment.

Since such a control panel is connected to the electric wire cable drawn out from the inside of the refrigerator main body, a structure has been disclosed to prevent the electric wire cable from being damaged by interference with the surroundings in a case where the freezing compartment door slides in and out.

Representatively, in the Republic of Korea, Patent Registration No. 10-1831614, is directed to a refrigerator that is intended to prevent damage to the electric wire cable due to sliding in and out of a drawer-type door.

However, in this prior art, since the electric wire cable is installed on the outside of the guide rail, it has a structure in which the electric wire cable may be damaged and disconnected in the process of sliding in and out of the drawer-type door.

In addition, since the control panel is mounted on the inside of the door, there is a problem in that it is impossible to replace the control panel due to failure or aging.

Technical Problem

An object of an embodiment of the present disclosure is to provide a refrigerator which is provided with an electric wire guide module for guiding the disposition of electric wires by connecting a drawer door that slides in and out and a main body.

An object of an embodiment of the present disclosure is to provide a refrigerator in which a control panel is provided on a drawer door through which a drawer slides in and out, and an electric wire guide module for guiding electric wires connecting the control panel and electric components is provided.

An object of an embodiment of the present disclosure is to provide a refrigerator that includes a control panel detachable from a drawer door through which the drawer slides in and out, and in which the control panel can be replaced in accordance with the aging and breakdown of the control panel.

Technical Solution

A refrigerator according to an embodiment of the present disclosure comprises a cabinet including storage space; a drawer door configured to be disposed in the storage space so as to be capable of drawing in and out, and including a door part forming a front surface, and a drawer part which is connected to the door part to be drawn in and out together with the door part and in which food is stored; a control panel configured to be mounted on the upper surface of the drawer part and configured to display or manipulate the setting of the storage space; and an electric wire guide module configured to connect the cabinet and the rear surface of the door part and guide the electric wire on the cabinet side to be connected to the control panel, in which the electric wire guide module includes a mounting plate mounted on the bottom surface of the storage space and having a mounting opening through which the electric wire of the cabinet side is taken in and out, a rotation connection member configured to communicate with the mounting plate to guide the electric wire of the cabinet side to the inside and rotatably mounted to the mounting plate, a guide head coupled to the rear surface of the door part, and a connecting member connecting the rotation connection member and the guide head, and through which an electric wire is taken in and out.

The storage space may be divided into an upper storage space and a lower storage space by a barrier, the drawer door may include an upper drawer door configured to open and close the upper storage space, and a lower drawer door configured to open and close the lower storage space, the control panel may be detachably coupled to the upper surface of the upper drawer door, and the mounting plate may be mounted on the barrier.

The mounting plate may include a recessed part that is recessed downward from the upper surface, and a circumferential part configured to extend along the circumference of the recessed part, and the recessed part may include a plurality of mounting openings and a plurality of mounting fastening holes through which a fastening member passes and which are fixed to a bottom surface of the storage space.

The mounting opening may be formed in a position eccentric to one side in front of the recessed part, and the mounting fastening hole may be asymmetrically disposed with respect to the mounting opening.

The rotation connection member may have a lower surface which is opened to communicate with the mounting opening, and a connection member restraining part extending outwardly and coupled to the mounting plate may be formed around the opened lower surface.

The rotation connection member may have one side which is opened so that the electric wire can pass therethrough, and a connection member connection part may be provided which is spaced apart from each other in the vertical direction with respect to an opening through which the electric wire passes, extends outwardly, and is coupled to one end of the connecting member.

A plurality of the connecting member may be configured to be connected to each other in the same structure between the rotation connection member and the guide head, and the connecting member may have surfaces facing each other which are opened to form a passage through which the electric wire passes.

A front connection part extending forward from an upper end and a lower end, respectively, and including an opened connection hole in the center may be provided on the opened front surface of the connecting member.

A rear connection part extending rearwardly from an upper end and a lower end, respectively, and including a rear protrusion protruding from the center may be provided on the opened rear surface of the connecting member.

A connecting hole which is recessed and provided with a connector connected to the control panel may be formed on the rear surface of the door part, and the guide head may include a head opening guiding the electric wire into the connecting hole.

The guide head may include a head connection part which is formed to protrude backward from the rear surface to couple to the connecting member, and connection protrusions coupled to the connection holes formed in the connecting member may be formed at the upper end and the lower end of the head connection part.

A door light irradiating light toward the inside of the drawer part may be provided on the rear surface of the door part, and the electric wire guide module may be electrically connected to the door light.

The door part may include an out plate forming a front surface, and a door panel coupled to the out plate to form a rear surface of the door part, and a control panel accommodating part recessed downwardly to accommodate the control panel may be formed on an upper surface of the door panel.

A support frame detachably mounted to the control panel may be disposed in the control panel accommodating part.

The support frame may include a frame bottom surface mounted on the bottom surface of the control panel accommodating part, and a frame coupling part bent upward along the circumference of the frame bottom surface and in contact with the side surface of the control panel, and a frame opening part coupled to a restraining part formed on the control panel may be formed on the frame coupling part.

A plurality of the frame coupling part may be formed by being spaced apart from each other at set intervals along the circumference of the bottom surface of the frame.

The frame coupling part may include a support part in contact with the lower end of the control panel to support the control panel from below; and a coupling part extending upward from the support part and coupled to the control panel.

The control panel may include a plate forming an outer appearance of the upper surface, a control frame disposed below the plate, and a PCB accommodated inside the control frame.

The control frame may include a side part extending downwardly around the lower side of the plate, and a plurality of the restraining parts may be formed on the side part.

A side cover formed to surround a side surface of the door panel may be provided on the door part, and the side cover may extend from a lower end of the door panel to an upper end of the control panel.

Advantageous Effect

According to an embodiment of the present disclosure, in a structure having a drawer door that slides in and out in a sliding manner, a control panel is provided in which a manipulation button for a user to manipulate a function of the refrigerator from the outside, a display for displaying an operation state are provided on the upper surface of the door part, and thus there is an advantage in that the user's convenience increases.

In addition, the electric wire supplying power to the control panel and the door light is connected by the electric wire guide module connected to the connecting hole formed in the center of the door part, and thus there is an advantage in that it is possible to prevent the electric wire from being damaged due to the sliding in and out of the door.

In addition, according to an embodiment of the present disclosure, the control panel is mounted to the door part in a state where the control panel is coupled to the support frame by hook coupling. Accordingly, there is an advantage in that it is easy to separate and assemble the control panel when a service situation occurs.

BEST MODE

Hereinafter, specific embodiments of the present disclosure will be described in detail with drawings. However, the present disclosure is not limited to the embodiments in which the spirit of the present disclosure is presented, but may be variously modified and altered by those skilled in the art to which the present disclosure pertains without departing from the spirit and scope of the present disclosure.

Figure 1:
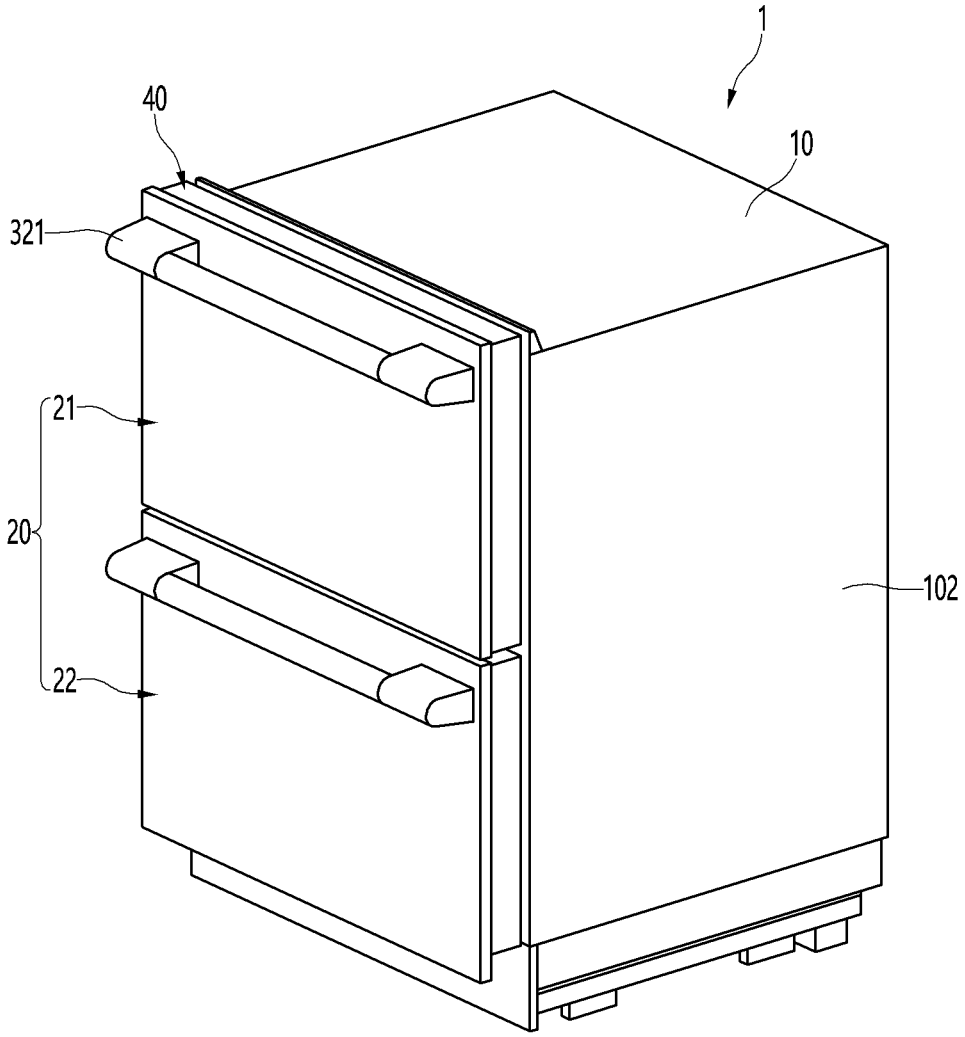
FIG. 1 is a perspective view illustrating a refrigerator according to an embodiment of the present disclosure.
Figure 2:
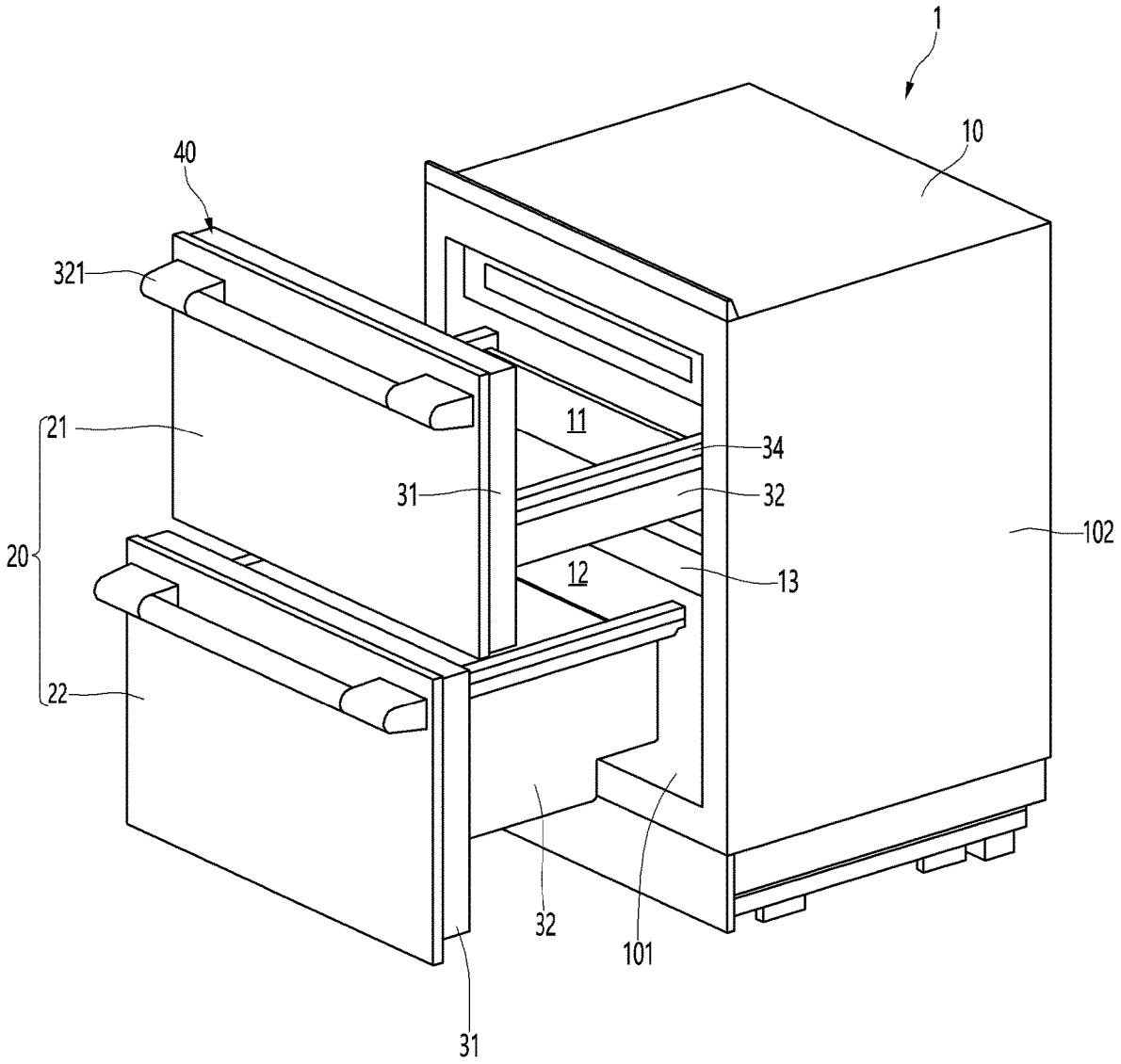
FIG. 2 is a view illustrating a state where the drawer door of the refrigerator is withdrawn.

FIG. 1 is a perspective view illustrating a refrigerator according to an embodiment of the present disclosure, and FIG. 2 is a view illustrating a state where the drawer door of the refrigerator is withdrawn.

As illustrated in the drawing, the refrigerator 1 may have an external shape formed by a cabinet 10 forming a storage space and a door 20 shielding the opened front surface of the cabinet 10.

The cabinet 10 may include an outer case 102 forming the outer appearance of the refrigerator 1 and an inner case 101 forming the storage spaces 11 and 12. A heat insulating material may be provided between the outer case 102 and the inner case 101 to insulate the storage space.

The storage space inside the cabinet 10 may be divided into a plurality of spaces. For example, the cabinet 10 may be divided vertically by a barrier 13 elongated in the horizontal direction. In other words, the cabinet 10 may include an upper storage space 11 formed at an upper part and a lower storage space 12 formed at a lower part. The upper storage space 11 and the lower storage space 12 may be maintained at the same temperature or at different temperatures while forming independent spaces according to a user's setting.

Of course, the upper storage space 11 may be used as a refrigerating compartment for refrigerated storage of food, and the lower storage space 12 may be used as a freezing compartment for freezing and storing food.

Meanwhile, the upper storage space 11 and the lower storage space 12 may be configured to be opened and closed by the door 20, respectively.

The door 20 may include an upper door 21 for opening and closing the upper storage space 11 and a lower door 22 for opening and closing the lower storage space 12. In addition, although not limited thereto, the upper door 21 and the lower door 22 may be provided in a drawer type in which the storage spaces 11 and 12 are opened and closed by sliding in and out in the front and rear directions. The door 20 may also be called as a drawer-type door in that the door 20 is drawn in and out of the storage space in a sliding manner.

In other words, the present disclosure has been described with reference to a refrigerator in which the drawer door 20 is disposed in the lower storage space 12, but the present disclosure is not limited thereto and may be apply to all types of refrigerators provided with a drawer-type door which is drawn in and out of the storage space.

In detail, the drawer door 20 may include a door part 31 forming a front surface of the door 20 and opening and closing the storage space, a drawer part 32 that is coupled to a rear surface of the door part 31 and is drawn in and out together with the door part 31.

The door part 31 may be exposed to the outside of the cabinet 10 to form the outer appearance of the refrigerator 1. The drawer part 32 may be disposed inside the cabinet 10 to form a storage space. In addition, the door part 31 and the drawer part 32 may be coupled to each other and configured to be drawn in and out together in the front and rear directions.

A rail frame 34 on which a draw-in and out rail 33 (See FIG. 5) for guiding the draw-in and out of the door 20 is mounted may be formed on the rear surface of the door part 31. The rail frame 34 may extend rearwardly from the rear surface of the door part 31, and a space for accommodating the draw-in and out rail 33 may be formed therein.

One end of the draw-in and out rail 33 may be fixed to the storage space inside the cabinet 10, and the other end thereof is fixed to the rail frame so that the door 20 can be drawn in and out more stably.

The door part 31 may be provided with a control panel 40 provided with manipulation buttons for a user to manipulate the functions of the refrigerator 1 from the outside, a display for displaying an operation state, and the like. The control panel 40 may be provided in the door part 31 forming the upper door 21.

In addition, a handle 321 that can be gripped by a user may be provided on the front surface of the door part 31.

The drawer part 32 is located on the rear surface of the door part 31 and may form a space in which food for storage or containers are accommodated. The inside of the drawer part 32 may form an accommodating space opened upward.

Draw-in and out rails 33 for guiding the draw-in and out of the drawer door 30 may be provided on both side surfaces of the drawer part 32. The drawer door 30 can be mounted on the cabinet 10 so as to be capable of being drawn in and out by the draw-in and out rail 33.

Meanwhile, the control panel 40 may be electrically connected to electrical components provided in the cabinet 10 by the electric wire guide module 90. The electric wire guide module 90 may be fixedly mounted inside the cabinet 10 and may have a structure connected to the door part 31.

Hereinafter, the electric wire guide module 90 according to an embodiment of the present disclosure will be described in detail.

Figure 3:
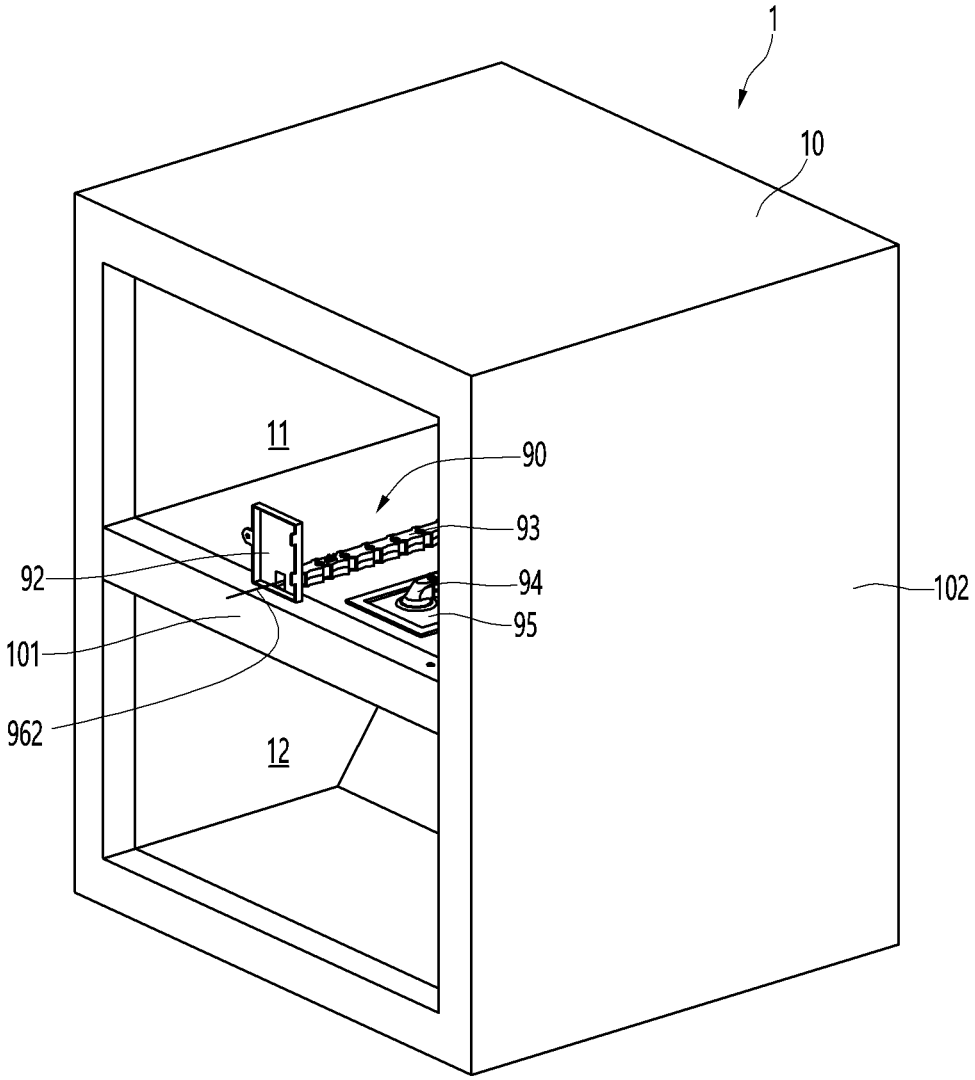
FIG. 3 is a view illustrating a state where the electric wire guide module is mounted in the cabinet of the refrigerator.
Figure 4:
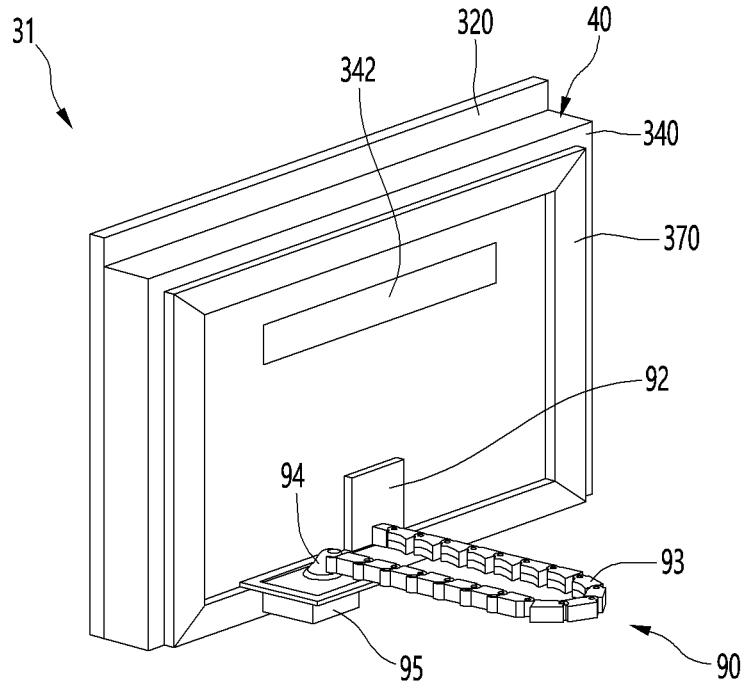
FIG. 4 is a rear view illustrating a state where the door cover of the door part forming the drawer door is removed.
Figure 5:
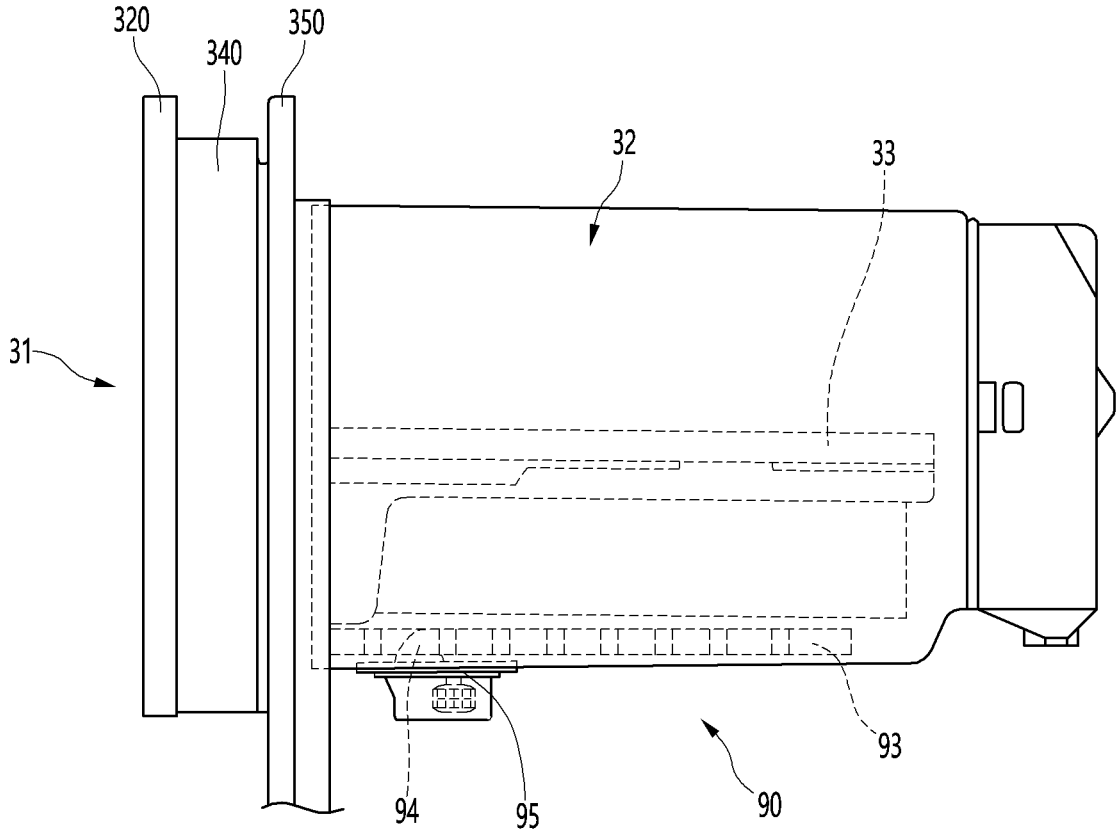
FIG. 5 is a side view illustrating the state of the drawer door and the electric wire guide module of the refrigerator.
Figure 6:
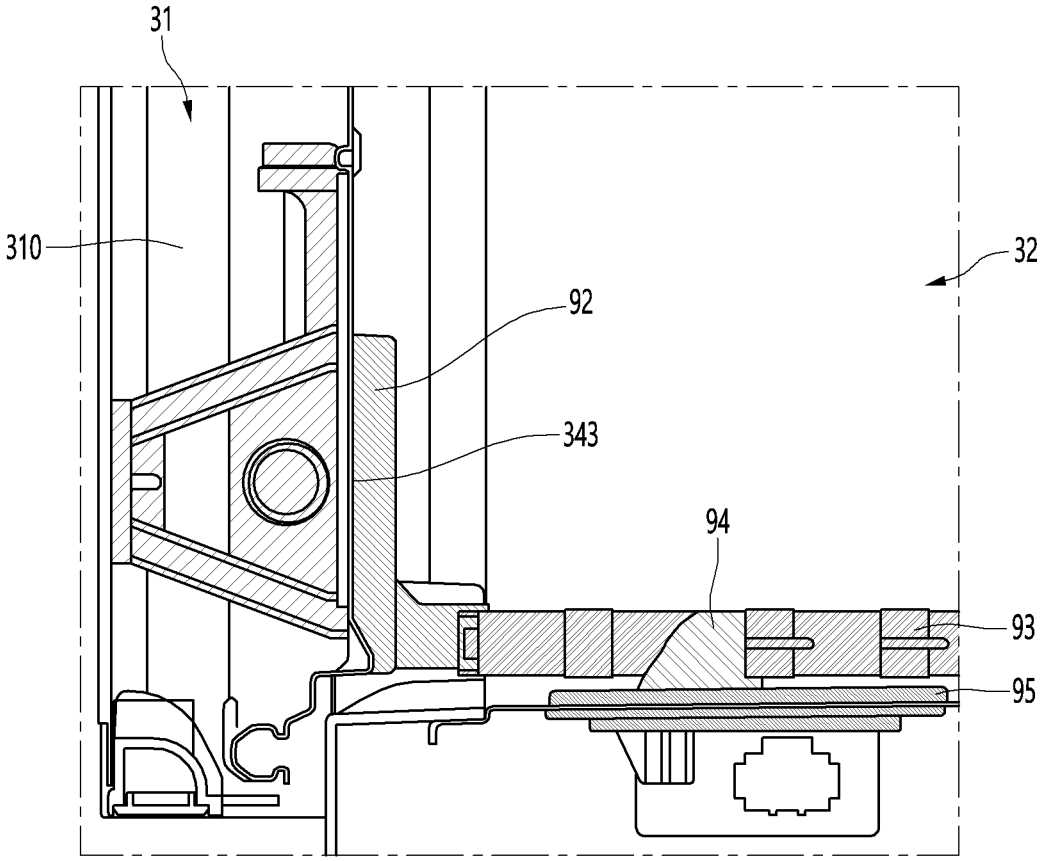
FIG. 6 is a cross-sectional view illustrating a state where the electric wire guide module is mounted on a drawer door and a cabinet.

FIG. 3 is a view illustrating a state where the electric wire guide module is mounted in the cabinet of the refrigerator, FIG. 4 is a rear view illustrating a state where the door cover of the door part forming the drawer door is removed, FIG. 5 is a side view illustrating the state of the drawer door and the electric wire guide module of the refrigerator, and FIG. 6 is a cross-sectional view illustrating a state where the electric wire guide module is mounted on a drawer door and a cabinet.

The electric wire guide module 90 may be provided inside the upper storage space 11. The electric wire guide module 90 is provided at a forward portion of the bottom surface of the upper storage space 11 and may be connected to the door part 31 of the upper door 21. Therefore, the electric wire guide module 90 can be drawn in and out together with the upper door 21.

In addition, an electric wire 962 is disposed inside the electric wire guide module 90, and the electric wire 962 may be guided to the door part 31 along the electric wire guide module 90.

The electric wire guide module 90 may include a guide head 92, a plurality of connecting members 93, a rotation connection member 94, and a mounting plate 95.

A mounting plate 95 may be mounted on the bottom surface of the upper storage space 11. The rotation connection member 94 may be rotatably mounted to the mounting plate 95. The mounting plate 95 may be formed at a position biased forward from the center of the bottom surface of the upper storage space 11.

Accordingly, the guide head 92 may be positioned at the center of the rear surface of the door part 31. A structure in which the guide head 92 and the rotation connection member 94 are disposed to be spaced apart from each other, and the portion between the guide head 92 and the rotation connection member 94 can be connected by the connecting member 93 may be provided.

Hereinafter, each configuration forming the electric wire guide module 90 will be described in more detail with reference to the drawings.

Figure 7:
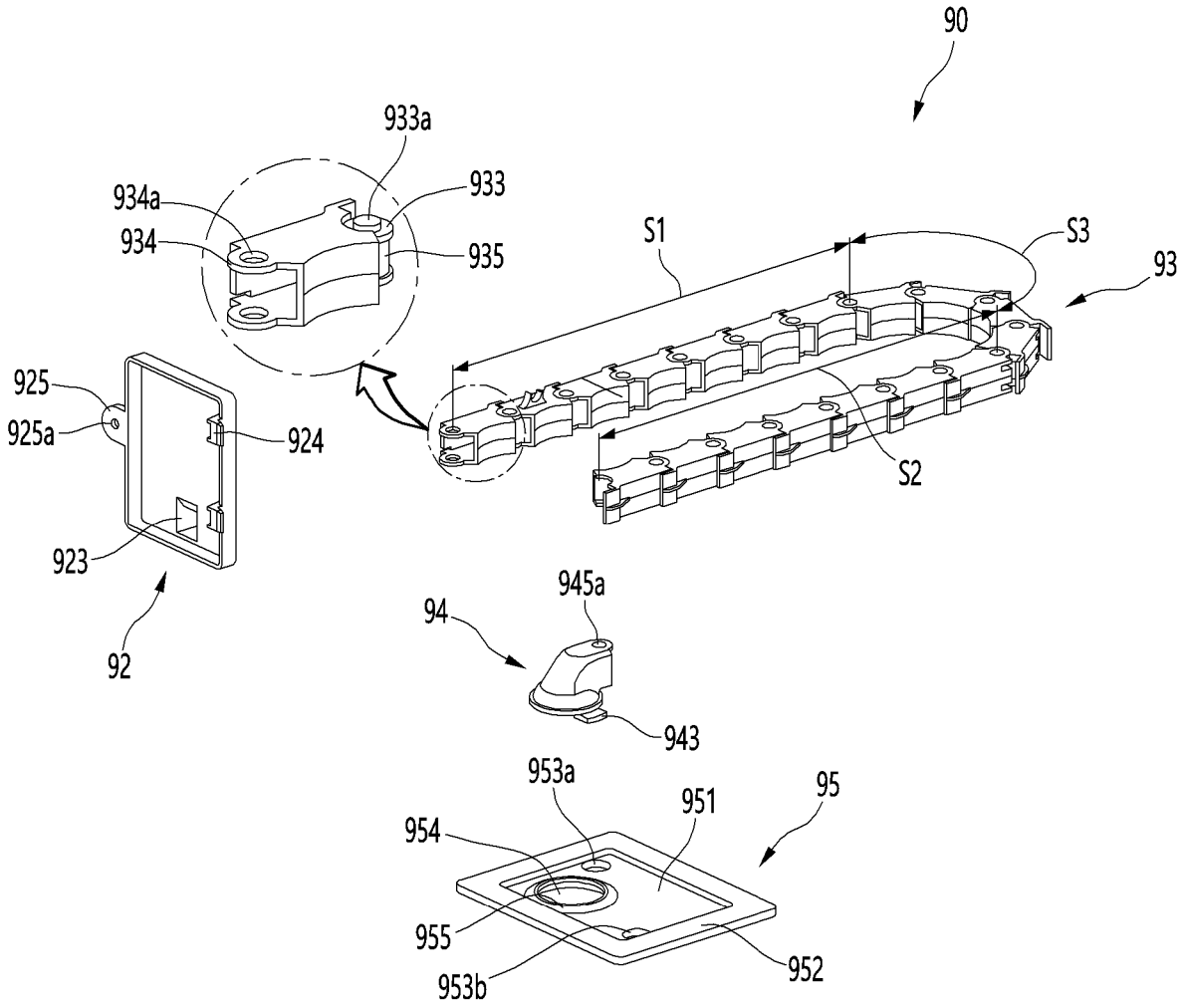
FIG. 7 is an exploded perspective view illustrating the electric wire guide module viewed from above.
Figure 8:
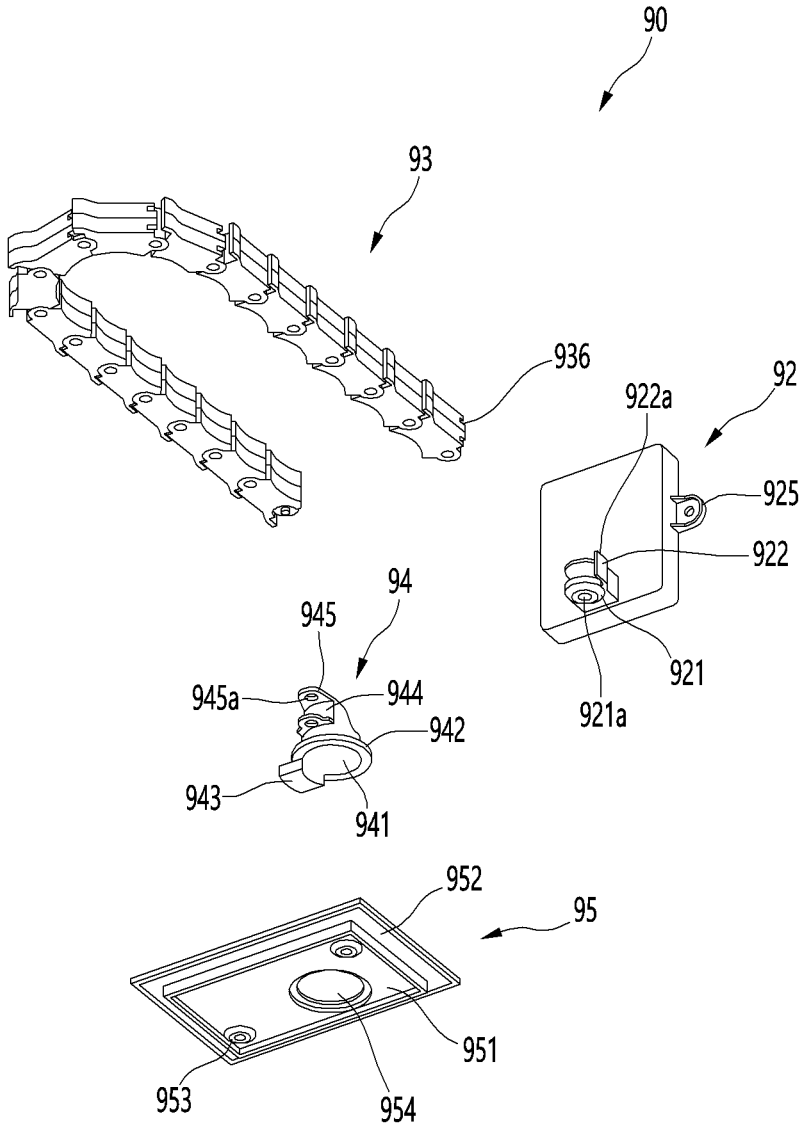
FIG. 8 is an exploded perspective view illustrating the electric wire guide module viewed from below.

FIG. 7 is an exploded perspective view illustrating the electric wire guide module viewed from above, and FIG. 8 is an exploded perspective view illustrating the electric wire guide module viewed from below.

As illustrated in the drawing, the electric wire guide module 90 may include a mounting plate 95 fixed to the bottom surface of the storage space 11, a rotation connection member 94 coupled to the mounting plate 95, and a guide head 92 fixed to the rear surface of the door part 31, and a connecting member 93 connected to the rotation connection member 94 by the guide head 92.

The mounting plate 95 is generally formed in a plate shape and may be mounted on the bottom surface of the storage space 11.

The mounting plate 95 may include a recessed part 951 having an upper surface depressed downward, and a circumferential part 952 extending outwardly along the circumference of the recessed part 951.

By this structure, in a state where the rotation connection member 94 is mounted with the mounting plate 95, exposure of the rotation connection member 94 to the outside is minimized, and thus there is an advantage in that it can be prevented the rotation connection member 94 from being damaged by an external impact.

In addition, the mounting plate 95 may have a mounting fastening hole 953 to which the fastening member is fastened. The fastening member passing through the mounting fastening hole 953 is fastened to the bottom surface of the storage space 11, the mounting plate 95, and the rotation connection member 94 mounted to the mounting plate 95 may be fixed to the bottom surface of the storage space 11. Here, the storage space may be the bottom surface of the cabinet 10, or in more detail, the top surface of the barrier 13 forming the bottom surface of the upper storage space 11.

A plurality of the mounting fastening holes 953 may be formed and may be asymmetrically disposed in the front and rear direction with respect to the center of the mounting plate 95. Specifically, the mounting plate 95 may be formed in a plate shape as a whole, and the mounting fastening hole 953 may be disposed at a position adjacent to a corner in the recessed part 951 region.

In addition, the mounting plate 95 may have a mounting opening 954 to which the rotation connection member 94 is mounted. The mounting opening 954 may be formed in a circular shape corresponding to a diameter of the rotation connection member 94.

The mounting opening 954 may allow an electric wire 962 for supplying power to the door 20 to enter and exit. The electric wire 962 introduced into the mounting opening 954 may be guided to the inside of the rotation connection member 94.

The mounting opening 954 may be formed at a position biased toward one side from the front in the region of the recessed part 951. A pair of mounting fastening holes 953 may be asymmetrically disposed about the mounting opening 954 as a center.

Specifically, the first mounting fastening hole 953*a* among the pair of mounting fastening holes 953 may be disposed at a position corresponding to a position where the mounting opening 954 is biased to one side. In addition, the second mounting fastening hole 953*b* may be located in a direction opposite to the first mounting fastening hole 953*a* diagonally. With this structure, it is possible to provide a space for the rotation connection member 94 to rotate in the recessed part 951 region without interference of the mounting fastening hole 953.

In addition, a mounting stepped part 955 protruding upward may be formed around the mounting opening 954. The mounting stepped part 955 may be formed to accommodate the connection member stepped part 942 formed in the rotation connection member 94.

The rotation connection member 94 is rotatably mounted on the mounting plate 95, and the inside thereof is hollow, so that the electric wire 962 passes through the inside of the rotation connection member 94 and may be guided toward the connecting member 93.

A lower surface of the rotation connection member 94 includes a lower surface opening 941 which is opened, communicates with the mounting opening 954, and through which the electric wire 962 can enter and exit. In addition, the connection member stepped part 942 may be formed around the opened lower surface of the rotation connection member 94. The connection member stepped part 942 may be accommodated inside the mounting stepped part 955. With this structure, the rotation connection member 94 is freely rotatable without being detached in a state of being mounted on the mounting stepped part 955.

In addition, a connection member restraining part 943 extending outwardly may be formed on a lower surface of the rotation connection member 94. The connection member restraining part 943 may protrude downward from the lower surface of the connection member stepped part 942 and may also extend to one side.

The connection member restraining part 943 may extend to be restrained on the lower surface of the mounting plate 95. In addition, the connection member restraining part 943 may extend to be restrained by the barrier 13 together with the mounting plate 95. Accordingly, even when an impact is applied to the rotation connection member 94, it is not easily separated from the mounting plate 95.

An opening 944 may be formed on one surface of the rotation connection member 94 to allow the electric wire 962 to pass therethrough.

The opening 944 allows the electric wire 962 passing through the inner side of the lower surface of the rotation connection member 94 to be guided into the connecting member 93.

In addition, a connection member connection part 945 coupled to the connecting member 93 may be formed on one surface of the rotation connection member 94.

A pair of connection member connection parts 945 may be formed by being spaced apart from each other in the vertical direction with respect to the opening 944. In addition, the connection member connection part 945 may extend outward from one surface of the rotation connection member 94 to be coupled to one end of the connecting member 93.

A connection hole 945*a* formed to be axially coupled to one end of the connecting member 93 may be formed in the connection member connection part 945. Accordingly, the connection hole 945*a* may be shaft-coupled to the rear protrusion 933*a* formed on one end of the connecting member 93, and the connecting member 93 may be rotated about the connection hole 945*a*.

Meanwhile, a plurality of the connecting members 93 have a structure in which they are continuously connected to each other and may be connected from the rotation connection member 94 to the guide head 92. The plurality of connecting members 93 connected to each other all have the same shape and may be continuously rotatably connected to each other. Accordingly, the structure to which the connecting member 93 is coupled may have a structure such as a chain. In addition, the electric wire 962 may sequentially pass through the inside of the plurality of connecting members 93 to be guided from the rotation connection member 94 to the guide head 92.

The connecting member 93 may be formed in a box shape with a hollow interior in the front and rear direction and may be formed so that the front and rear surfaces are opened to allow the electric wire 962 to pass therethrough.

Front connection part 934 extending forward, respectively, may be formed on the upper and lower ends of the opened front surface of the connecting member 93. The front connection part 934 may have a rounded end part, and an opened connection hole 934*a* may be formed in the center.

In addition, a rear connection part 933 may be formed to extend outwardly at the upper end and lower end of the opened rear surface of the connecting member 93, respectively. In addition, rear protrusions 933*a* each protruding may be formed on the upper and lower surfaces of the pair of rear connection parts 933. The rear protrusion 933*a* may be inserted into the connection hole 934*a* of the adjacent connecting member 93.

In addition, a rear extension part 935 may be further formed between the rear connection portions 933, that is, at one end of the opened rear surface of the connecting member 93. The rear extension part 935 extends to protrude more than the other facing side surfaces, so that rotation of the connecting member 93 in one direction is restricted so that the connecting member 93 has directionality.

With this structure, the plurality of connecting members 93 may have a structure in which they are continuously connected to each other. In addition, the plurality of connecting members 93 may be connected as a whole in a "U" shape. The connecting members 93 may be continuously connected to the rear to extend, and then to be connected to the front again. The connecting member 93 may extend to include a straight section S1, S2 connected in a straight line in the front and rear direction and a bending section S3 connecting the straight sections S1, S2 on both sides.

In addition, the rotation connection member 94 and the guide head 92 may be connected to the extended end parts of the connecting member 93, respectively.

In this case, the length of the straight section S1 connected to the guide head 92 may be maintained even when the drawer door 30 is drawn in and out. On the other hand, the length of the straight section S2 and the bending section S3 connected to the rotation connection member 94 may be changed according to the drawer door 30 being drawn in and out.

In addition, the total length to which the plurality of connecting members 93 are connected can be formed to be longer than the draw-in and out distance of the drawer door 30, so that the electric wire 962 can be stably guided to the drawer door 30.

Meanwhile, the guide head 92 may be connected to an end of the connecting member 93 in a state of being mounted on the door part 31. The guide head 92 may be located at a lower center part of the rear surface of the door part 31. The guide head 92 may be mounted in a connecting hole 343 formed in the door part 31.

The guide head 92 may be formed in a rectangular frame shape with an open front surface. The guide head 92 includes a head connection part 921 connected to the connecting member 93.

The head connection part 921 may be formed to protrude backward from the rear surface of the guide head 92. A connection protrusion 921*a* coupled to the connecting member 93 may be formed at the upper end and lower end of the head connection part 921.

The connection protrusion 921*a* may be formed to protrude backward from the head connection part 921. In addition, a pair of the connection protrusions 921*a* may be formed by protruding upward or downward from the upper end and lower end of the head connection part 921. The connection protrusion 921*a* may be coupled to a connection hole 945*a* connected to the connecting member 93 so that the guide head 92 is rotatably connected to the connecting member 93.

In addition, the guide head 92 may include a head fixing part 922 extending rearwardly from one side surface of the head connection part 921. The head fixing part 922 may be formed to have a height corresponding to the vertical length of the head connection part 921. The head fixing part 922 may include a fixing rib 922*a* inserted into the fixing groove 936 formed on one side surface of the connecting member 93. The fixing rib 922*a* may be formed to protrude outward from the head fixing part 922. The fixing rib 922*a* is coupled to the fixing groove 936 to prevent the connecting member 93 from being separated in a state of being to be connected to the guide head 92, and to be capable of maintaining a more stable mounting state. In addition, by guiding a portion where one end of the connecting member 93 is connected to the guide head 92, misalignment can be prevented.

The guide head 92 is opened at a position corresponding to the head connection part 921 to form a head opening 923 for guiding the electric wire 962. The head opening 923 may guide the electric wire inside the connecting member 93 toward the inside of the door part 31 through the guide head 92.

In addition, the guide head 92 may include a locking part 924 inserted into the door part 31 to be latched. The locking part 924 may be formed to protrude outward from one side surface of the guide head 92 and may be formed in plurality along the circumference of the guide head 92.

A head coupling part 925 including a head coupling hole 925*a* may be formed on one front side of the guide head 92. The head coupling part 925 may be formed to protrude outward from one side of the guide head 92. A fastening member may be fastened to the head coupling hole 925*a*, and the fastening member may pass through the head coupling hole 925*a* to be fastened to the door part 31. By fastening the fastening member, the guide head 92 may be more firmly fixed to the door part 31.

Accordingly, the guide head 92 may be connected to the connecting member 93 in a state of being mounted on the door part 31. The electric wire inside the connecting member 93 may be guided toward the connecting hole 343 formed in the door part 31 through the head opening 923 of the guide head 92. In addition, the electric wire 962 guided inside the connecting hole 343 may be connected to a door-side connector provided inside the connecting hole 343. The door-side connector may be connected to electric wires connected to electrical components provided in the door part 31. Electrical components connected to the door-side connector may include the control panel 40, the door light 342, and the like. In addition, the electrical components are provided inside the door part 31 and may further include other components that require power connection.

Hereinafter, the door part including the control panel 40 according to an embodiment of the present disclosure will be described in detail.

Figure 9:
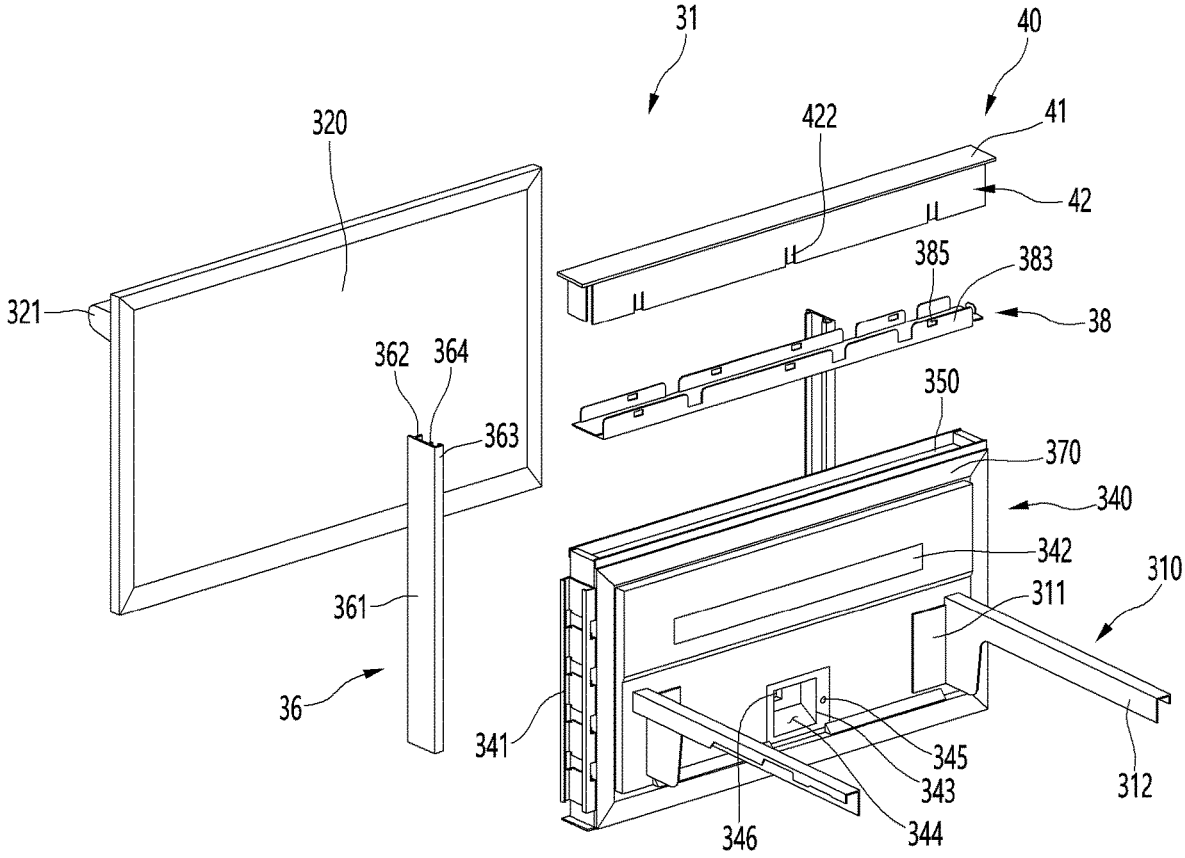
FIG. 9 is an exploded perspective view illustrating the drawer door.
Figure 10:
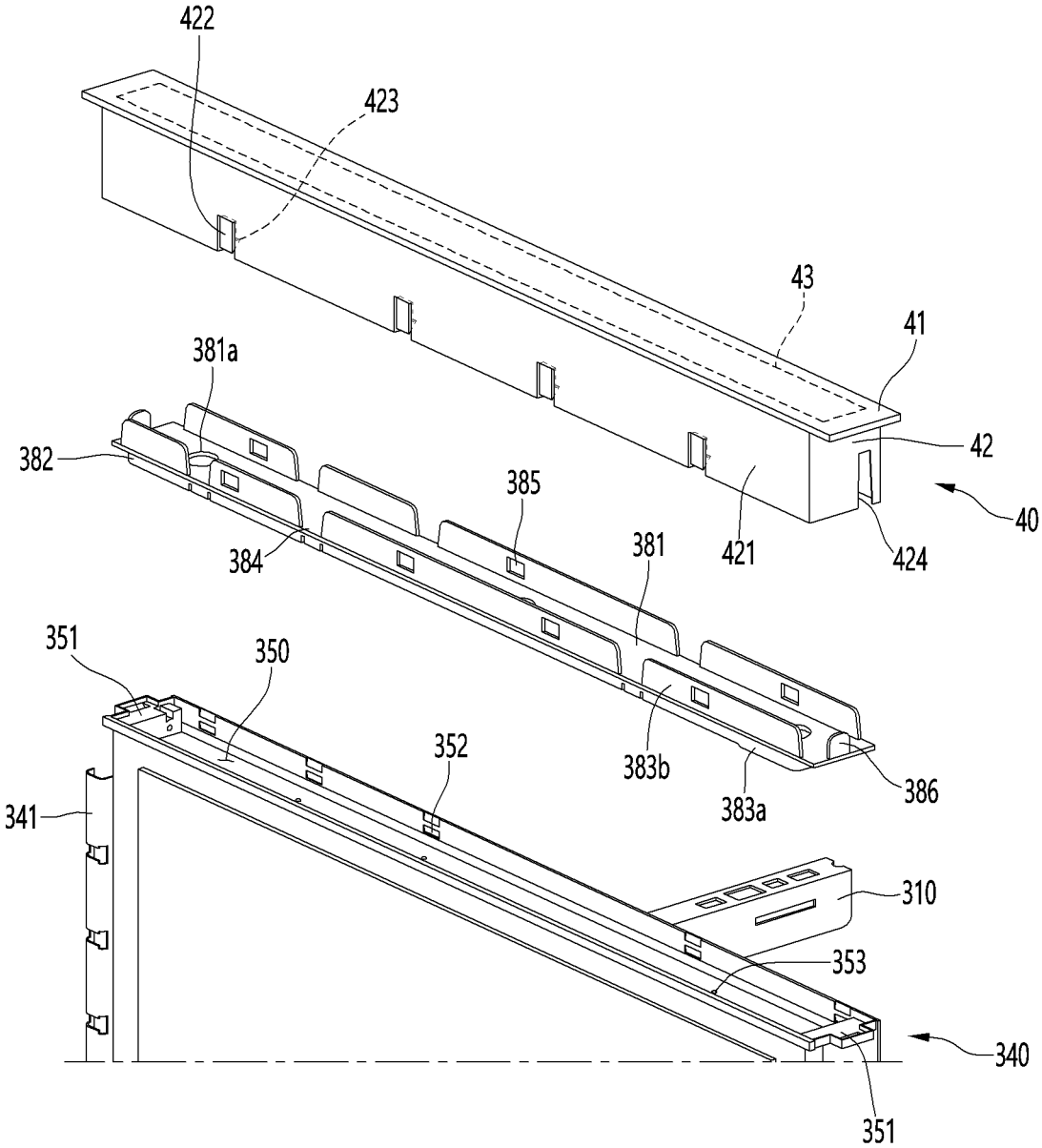
FIG. 10 is an exploded perspective view illustrating a control panel according to an embodiment of the present disclosure.

FIG. 9 is an exploded perspective view illustrating the drawer door, and FIG. 10 is an exploded perspective view illustrating a control panel according to an embodiment of the present disclosure.

The door part 31 and the drawer part 32 constituting the drawer door 20 may have a structure in which they can be separated and coupled to each other. Through the separable structure of the door part 31 and the drawer part 32, assembly workability and serviceability can be improved.

The rear surface of the door part 31 and the front surface of the drawer part 32 may be coupled to each other. The door part 31 and the drawer part 32 may be coupled by a pair of door frames 310 provided on both sides. In addition, the door panel 340 may be covered by the door cover 350.

The door frame 310 may include a door coupling part 311 extending in the vertical direction and coupled to the door part 31, and a drawer coupling part 312 extending rearward from the lower end of the door coupling part 311. The door coupling part 311 may be coupled to the door part 31 by a separate coupling member or may be coupled to one side of the door part 31 by a simple coupling structure. In addition, the drawer coupling part 312 may be mounted on both sides of the drawer part 32 and may be inserted and mounted in a state coupled to the draw-in and out rail 33.

Meanwhile, the door part 31 is formed to form the front outer appearance of the refrigerator 1. The door part 31 includes an out plate 320 forming a front surface and a part of a circumferential surface, and a door panel 340 coupled to the out plate 320 to form a rear surface of the door part 31. In addition, the control panel 40 is disposed on an upper surface of the door panel 340, and side covers 36 are disposed on both side surfaces of the door panel 340, so that an outer appearance thereof may be formed by the side cover 36.

The out plate 320 may be provided with a handle 321 that can be gripped by a user's hand. Panel coupling parts 341 coupled to the out plate 320 may be formed on both side surfaces of the door panel 340. The panel coupling part 341 may be screw-coupled to the out plate 320 by a fastening member.

The door panel 340 may be made of a metal material. In addition, an adiabatic material may be filled inside the door panel 340 to insulate the inside of the storage spaces 11 and 12.

In addition, a door light 342 may be mounted on the rear surface of the door panel 340. A recessed space is provided on the rear surface of the door panel 340 and the door light 342 may be mounted thereon. The door light 342 may be positioned higher than the opened upper surface of the drawer part 32 to radiate light from the front of the drawer part 32 toward the inside of the drawer part 32.

The door light 342 is elongated in the horizontal direction from the left side to the right side of the rear surface of the drawer door 20 and may be located in the inner region of the gasket 370 formed along the rear circumference of the drawer door 20.

In addition, a connecting hole 343 that is recessed inwardly is formed in the center of the lower rear surface of the door panel 340. A connector for connecting the door light 342 and an electric wire connected to the control panel 40 may be provided inside the connecting hole 343.

In addition, the connecting hole 343 may be shielded by the guide head 92. The electric wire guided by the guide head 92 may be connected to a connector disposed inside the connecting hole 343 to supply power to the door light 342 and the control panel 40.

The connecting hole 343 includes a front surface opened in a rectangular shape as a whole and a space 344 recessed inward from the front surface, in which the connector is accommodated.

A fastening hole 345 to which a fastening member passing through the head coupling part 925 is fastened may be formed outside the connecting hole 343. Accordingly, the guide head 92 and the door panel 340 may be more firmly coupled.

In addition, a locking groove 346 coupled to the locking part 924 formed in the guide head 92 may be formed in the connecting hole 343.

Meanwhile, the door panel 340 includes a control panel accommodating part 350 that is recessed downward to accommodate a part of the control panel 40 on the upper surface. The control panel accommodating part 350 may be formed to elongate left and right along the upper surface of the door panel 340. The support frame 38 is accommodated in the control panel accommodating part 350. In addition, a portion of the control panel 40 coupled to the support frame 38 may be accommodated in the control panel accommodating part 350. In addition, the support frame 38 and the control panel 40 may be detachably coupled.

Stepped parts 351 stepped upward may be provided on both side ends of the control panel accommodating part 350. The stepped part 351 may have a shape corresponding to the frame stepped part 382 formed on the support frame 38. The bottom surface 381 of the support frame may be seated on the bottom surface of the control panel accommodating part 350. In addition, the support frame 38 may extend to the stepped part 351 of the control panel accommodating part 350 to be more firmly coupled to the door panel 340.

In addition, a plurality of restraining grooves 352 may be formed in the front and rear surfaces of the control panel accommodating part 350. A plurality of the restraining grooves 352 may be formed along the circumference of the control panel accommodating part 350.

The restraining groove 352 is coupled to the accommodating part coupling part 382 of the support frame 38 so that the support frame 38 can be hook-coupled to the door panel 340.

In addition, although the control panel 40 is disposed on the door part 31, it is provided in a space recessed above the door panel 340 and is not embedded in the adiabatic material. In addition, it is possible to prevent the adiabatic material inside the door panel 340 from penetrating into the control panel 40 by the support frame 38.

The support frame 38 may be mounted on the control panel accommodating part 350 formed by being recessed downward from the upper surface of the door part 31. The support frame 38 is mounted inside the control panel accommodating part 350 so that the control panel 40 can be fixedly mounted to the door part 31.

The support frame 38 is not limited, but may be formed of a material having elasticity.

The support frame 38 has an open upper surface, is formed to have a size corresponding to that of the control panel accommodating part 350 and includes a frame bottom surface 381 in contact with the upper surface of the door part 31.

The frame bottom surface 381 may be mounted and fixed to the bottom surface of the control panel accommodating part 350. At both side ends of the frame bottom surface 381, a frame stepped part 382 stepped upward may be formed. The frame stepped part 382 may be formed in a shape corresponding to the stepped part 351 of the control panel accommodating part 350. The frame stepped part 382 may prevent the support frame 38 from being more firmly mounted on the door part 31 and being separated.

In addition, the frame bottom surface 381 includes a frame fastening part **381*a* formed so that the fastening member passes therethrough. A plurality of frame fastening part 381*a* may be formed along the frame bottom surface 381. The fastening member passing through the through-hole 353 provided in the control panel accommodating part 350 passes through the frame fastening part 381*a*, so that the support frame 38 may be fixed to the control panel accommodating part 350**.

In addition, the support frame 38 includes a frame coupling part 383 that is bent upward along the circumference of the frame bottom surface 381 to contact the side surface of the control panel 40. A plurality of the frame coupling part 383 may be formed by being spaced apart from each other at a predetermined distance along the circumference of the frame bottom surface 381. For example, the frame coupling part 383 may be arranged along a set interval along the front and rear ends of the frame bottom surface 381, respectively. For example, the frame coupling part 383 may be arranged so as to be symmetrical to the front end and the rear end with respect to the frame bottom surface 381.

In addition, frame cutouts 384 formed at regular intervals are provided between the adjacent frame coupling parts 383. Accordingly, in the process of hooking the support frame 38 to the control panel 40, each of the frame coupling parts 383 can move more flexibly, thereby facilitating the assembly operation.

In addition, in the space between the adjacent frame coupling parts 383, a receiving part coupling part 382 for coupling with the control panel accommodating part 350 may be formed. The accommodating part coupling part 382 may be coupled with the restraining groove 352 formed along the circumference of the control panel accommodating part 350 so that the support frame 38 may be hook-coupled to the door panel 340.

The frame coupling part 383 may be formed along the circumference of the front end and the rear end with respect to the upper surface of the door part 31. In addition, the height at which the frame coupling part 383 is bent from the bottom surface 381 of the frame and extends upward may correspond to or be lower than the height of the side surface of the control panel 40.

The frame coupling part 383 includes a support part 383*a* that is in contact with the lower end of the control panel 40 to support the control panel 40 from below, and a coupling portion 383*b* extending upward from the support part 383*a* to couple the control panel 40.

The frame coupling part 383 includes a frame opening part 385 which is coupled to the restraining part 422 formed in the control panel 40 and is opened so that the support frame 38 can be coupled to the control panel 40. A plurality of frame opening parts 385 may be provided along both sides of the coupling part 383*b*.

In addition, protrusions 386 formed to protrude upward from the bottom surface may be further formed at both side ends of the support frame 38. When the control panel 40 is mounted on the support frame 38, the protrusion 386 may contact both side surfaces of the control panel 40 to support the control panel 40.

With this structure, the support frame 38 and the control panel 40 can be simply assembled without requiring a separate fastening member.

The control panel 40 may be provided with a manipulation button for a user to manipulate the function of the storage space from the outside, and a display for displaying an operating state.

The control panel 40 may be elongated along the upper surface of the door part 31 and may be formed in a rectangular parallelepiped shape with an open lower surface as a whole. In addition, the PCB 43 may be accommodated inside the control panel 40.

The control panel 40 may include a plate 41 exposed to the outside while forming an outer appearance of an upper surface, a control frame 42 disposed below the plate 41, and a PCB 43 disposed below the control frame 42 or accommodated inside the control frame 42.

The plate 41 may be formed of a transparent or translucent material. The plate 41 may be formed to have a size corresponding to the upper surface of the door part 31, that is, to put it differently, the control panel accommodating part 350.

Both ends of the plate 41 may be disposed at positions corresponding to the end parts of the stepped part 351 formed in the control panel receiving portion 350. In other words, the length in the horizontal direction of the plate 41 may be formed to be longer on both sides than the control frame 42. In addition, the length of the plate 41 in the horizontal direction may be formed to have a length corresponding to the length of both ends of the support frame 38.

Accordingly, the plate 41 can prevent the PCB 43, the control frame 42, and the support frame 38 from being exposed to the outside.

The PCB 43 may be provided with various display means including an LED. In addition, the PCB 43 may further include a switch, a touch sensor, a button, and the like. Various elements may be installed in the PCB 43.

The control frame 42 may include a side portion 421 extending downward from the lower circumference of the plate 41. In addition, while the PCB 43 is accommodated in the side portion 421, the waterproofness of the PCB 43 may be secured.

A plurality of restraining parts 422 protruding outward from the outer surface may be formed on the side part. The support frame 38 and the control frame 42 may be fixed by the restraining part 422.

The restraining part 422 may be formed to be inclined in an inner direction as it extends upward from the lower side or to put it differently, in a direction closer to the direction in which the PCB is disposed. In other words, the restraint part 422 may include an inclined part 423 inclined inward from the lower end to the upper end.

In a state where the lower end of the control frame 42 is seated on the support part 383*a* of the support frame 38, the frame coupling part 383 may be inserted into the control frame 42. In this case, the restraining part 422 may pass through the frame opening part 385 so that the control panel 40 and the support frame 38 may be hook-coupled to each other.

In addition, the operator may press the control frame 42 to easily release the hook coupling between the restraint part 422 and the frame opening 385. Therefore, in a case where repair work such as replacement of the control panel is required, there is an advantage that the operator can easily release or couple the hook coupling to replace and separate the control panel 40.

Both side surfaces of the control frame 42 may be formed with cutouts 424 cut to be elongated in the vertical direction. The cutout 424 allows the control frame 42 to move flexibly when the support frame 38 and the hook are coupled or separated so that assembly and separation operations can be easily performed.

The control panel 40 may be mounted on the upper surface of the door panel 340 in a state of being coupled to the support frame 38.

Meanwhile, side covers 36 are provided on both sides of the door part 31. A pair of side covers 36 may be provided on both sides of the door panel 340 to cover both side surfaces of the door panel 340.

The side cover 36 may be bent a plurality of times and may be formed to cover a portion of a side surface, a front surface, and a rear surface of the door panel 340. The side cover 36 may include a body part 361 in contact with a side surface of the door panel 340, a first bent part 362 bent and extended from the front end of the body part 361, and a second bent part 363 that is bent and extended at the rear end of the body part 361. The first bent part 362 and the second bent part 363 may be formed to have a symmetrical shape with respect to the body part 361 and may be formed to surround a portion of the front and rear surfaces of the door panel 340.

The side cover 36 may be formed to be longer than the length of the door panel 340 in the vertical direction. The side cover 36 may extend from the lower end of the door panel 340 to a height corresponding to the plate 41 in a state where the control frame 42 is mounted. With this structure, the side cover 36 prevents both side surfaces of the support frame 38 mounted on the upper surface of the door panel 340 and the control panel 40 from being exposed to the outside, thereby providing a cleaner outer appearance.

In addition, the side cover 36 may further include coupling ribs 364 coupled to both side surfaces of the control frame 42. The coupling rib 364 may be inserted into the cutout 424 formed in the control frame 42 to prevent the control panel 40 from moving. Accordingly, there is an advantage that the control panel 40 can be more firmly mounted on the door part 31.

According to an embodiment of the present disclosure, the control panel 40 is coupled to the support frame 38 by a hook coupling, and thus there is an advantage in that separation and assembly are simple so that the replacing or repairing operation of the control panel 40 is easy.

In addition, according to an embodiment of the present disclosure, in the structure having the drawer door 20 that is drawn in and out in a sliding manner, the control panel 40 and the door light 342 are provided in the door part 31, the user's convenience can be increased. Then, the electric wire supplying power to the control panel 40 and the door light 342 is connected by the electric wire guide module 90 connected to the connecting hole 343 formed in the center of the door part 31, and thus there is an advantage of preventing the electric wire from being damaged according to the draw-in and out of the door.

The invention claimed is:

1. A refrigerator comprising:

a cabinet including a first storage space, a bottom of the first storage space defined by a surface of the cabinet;

a first drawer door located in the first storage space, the first drawer door being slidable in and out of the first storage space, the first drawer door including:

a door part defining a front of the first drawer door, the door part having a front surface, a rear surface, and an upper surface; and a drawer part connected to the door part, the drawer part being configured to store food;

a control panel located on the upper surface of the door part, the control panel being configured to display or manipulate a setting of the first storage space; and an electric wire guide module connected to the surface of the cabinet defining the bottom of the first storage space and the rear surface of the door part and connecting an electric wire in the cabinet to the control panel, the electric wire guide module including:

a mounting plate mounted to the surface of the cabinet defining the bottom of the first storage space, the mounting plate having a mounting opening through which the electric wire extends;

a rotation connection member rotatably mounted to the mounting plate, the rotation connection member being in communication with the mounting opening to receive and guide the electric wire;

a guide head coupled to the rear surface of the door part; and at least one connecting member connecting the rotation connection member and the guide head, the electric wire extending through the at least one connecting member, wherein the rotation connection member includes:

a lower side that is open to communicate with the mounting opening, and a rear side that is open to communicate with one side opening of the at least one connecting member, wherein the lower side and the rear side are opened in directions intersecting each other.

2. The refrigerator of claim 1, wherein the cabinet includes a second storage space separated from the first storage space by a barrier, the second storage space being below the first storage space, wherein an upper surface of the barrier is the surface of the cabinet defining the bottom of the first storage space, and wherein the refrigerator further includes a second drawer door to open and close the second storage space.

3. The refrigerator of claim 1, wherein the mounting plate includes an upper surface and a recessed part recessed downward from the upper surface, the recessed part includes the mounting opening and a plurality of mounting fastening holes to receive fastening members to mount the mounting plate to the surface of the cabinet defining the bottom of the first storage space.

4. The refrigerator of claim 3, wherein the mounting opening is located in a position offset forward of and to one side of a center of the recessed part, and wherein the mounting fastening holes are asymmetrically located with respect to the mounting opening.

5. The refrigerator of claim 1, wherein the rotation connection member has a connection member restraining part extending outwardly from the lower side to couple the rotation connection member to the mounting plate.

6. The refrigerator of claim 5, wherein the rotation connection member includes a pair of connection member connection parts vertically spaced apart to connect the rotation connection member to one end of the connecting member; and wherein the rear side is located between the pair of connection member connection parts through which the electric wire extends.

7. The refrigerator of claim 1, wherein the at least one connecting member is a plurality of connecting members, and adjacent said connecting members are connected to each other to extend between the rotation connection member and the guide head, and wherein a first end and a second end of each said connecting member has an opening to form a passage through which the electric wire extends.

8. The refrigerator of claim 7, wherein the first end of each said connecting member includes a front connection part extending forward from an upper portion and a lower portion of the first end, respectively, and each said front connection part has a connection hole in a center thereof.

9. The refrigerator of claim 7, wherein the second end of each said connecting member includes a rear connection part extending rearward from an upper portion and a lower portion of the second end, respectively, and each said rear connection part has a rear protrusion protruding vertically from a center thereof.

10. The refrigerator of claim 1, wherein the rear surface of the door part has a recessed connecting hole, wherein a connector connected to the control panel is provided in the recessed connecting hole, and wherein the guide head includes a head opening through which the electric wire extends into the connecting hole to be connected to the connector.

11. The refrigerator of claim 10, wherein one connecting member of the at least one connecting member has a first end having a pair of connection holes, wherein the guide head includes a head connection part protruding rearward from the rear surface of the door part, the head connection part having connection protrusions at upper and lower portions of the head connection part, and wherein the connection protrusions are coupled to the pair of connection holes of the one connecting member of the at least one connecting member.

12. The refrigerator of claim 1, wherein a door light is located at the rear surface of the door part, and wherein the electric wire is electrically connected to the door light.

13. The refrigerator of claim 1, wherein the door part includes:

an outer plate defining the front surface of the door part;

a door panel coupled to the outer plate and defining the rear surface of the door part; and a control panel accommodating part recessed downwardly from the upper surface of the door panel to accommodate the control panel therein.

14. The refrigerator of claim 13, wherein a support frame is located in the control panel accommodating part, and the control panel is detachably connected to the support frame.

15. The refrigerator of claim 14, wherein the control panel accommodating part has a bottom surface, wherein the control panel includes a side surface having at least one restraining part, and wherein the support frame includes:

a frame bottom mounted on the bottom surface of the control panel accommodating part; and at least one frame coupling part extending upward along a circumference of the frame bottom to contact the side surface of the control panel, the frame coupling part having a frame opening to receive the at least one restraining part of the control panel.

16. The refrigerator of claim 15, wherein the at least one frame coupling part is a plurality of frame coupling parts spaced apart from each other at set intervals along the circumference of the frame bottom.

17. The refrigerator of claim 15, wherein the frame coupling part includes:

a support part contacting a lower end of the control panel to support the control panel from below; and a coupling part extending upward from the support part and coupled to the side surface of the control panel.

18. The refrigerator of claim 15, wherein the control panel includes:

a plate defining an upper surface of the control panel;

a control frame located below the plate; and a printed circuit board inside the control frame.

19. The refrigerator of claim 18, wherein the control frame includes a side part extending downwardly from a lower surface of the plate, the side part defining the side surface, and wherein the at least one restraining part is a plurality of restraining parts on the side part.

20. The refrigerator of claim 13, wherein the door part includes a side cover to surround a side surface of the door panel, and wherein the side cover extends from a lower end of the door panel to an upper end of the control panel.

* * * * *